US006780357B2

(12) United States Patent
Dugan et al.

(10) Patent No.: US 6,780,357 B2
(45) Date of Patent: Aug. 24, 2004

(54) SPLITTABLE MULTICOMPONENT POLYESTER FIBERS

(75) Inventors: Jeffrey S. Dugan, Erwin, TN (US); Frank O. Harris, Rogersville, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 0 days.

(21) Appl. No.: 10/290,751

(22) Filed: Nov. 8, 2002

(65) Prior Publication Data

US 2003/0062658 A1 Apr. 3, 2003

Related U.S. Application Data

(62) Division of application No. 09/396,669, filed on Sep. 15, 1999, now abandoned.

(51) Int. Cl.[7] ..... B32B 31/00; D01D 5/22; D01D 5/253; D01D 5/26; D01D 5/32; D01D 5/42; D01G 1/00; D02G 1/00; D04H 3/02

(52) U.S. Cl. ..... 264/78; 19/0.6; 19/98; 28/271; 156/148; 156/167; 156/181; 156/256; 264/103; 264/143; 264/147; 264/168; 264/172.12; 264/172.14

(58) Field of Search ..... 264/78, 103, 143, 264/147, 168, 172.12, 172.14; 156/148, 167, 181, 256; 19/0.6, 98; 28/271

(56) References Cited

U.S. PATENT DOCUMENTS

| | | | |
|---|---|---|---|
| 3,972,759 | A | 8/1976 | Buntin |
| 3,987,185 | A | 10/1976 | Bare et al. |
| 4,118,534 | A | 10/1978 | Stanley |
| 4,239,720 | A | 12/1980 | Gerlach et al. |
| 4,364,983 | A | 12/1982 | Brücher et al. |
| 4,622,259 | A | 11/1986 | McAmish et al. |
| 4,663,221 | A | 5/1987 | Makimura et al. |
| 4,789,592 | A | 12/1988 | Taniguchi et al. |
| 5,010,145 | A | 4/1991 | Ikada et al. |
| 5,057,368 | A | 10/1991 | Largman et al. |
| 5,069,970 | A | 12/1991 | Largman et al. |
| 5,108,820 | A | 4/1992 | Kaneko et al. |
| 5,142,023 | A | 8/1992 | Gruber et al. |
| 5,162,074 | A | 11/1992 | Hills |
| 5,277,976 | A | 1/1994 | Hogle et al. |
| 5,336,552 | A | 8/1994 | Strack et al. |
| 5,382,400 | A | 1/1995 | Pike et al. |
| 5,593,778 | A | 1/1997 | Kondo et al. |
| 5,698,322 | A | 12/1997 | Tsai et al. |
| 5,707,735 | A | 1/1998 | Midkiff et al. |
| 5,759,926 | A | 6/1998 | Pike et al. |
| 5,760,144 | A | 6/1998 | Ozeki et al. |
| 5,783,503 | A | 7/1998 | Gillespie et al. |
| 5,807,973 | A | 9/1998 | Gruber et al. |

FOREIGN PATENT DOCUMENTS

| | | | |
|---|---|---|---|
| EP | 0 669 358 | A1 | 8/1995 |
| EP | 0 765 959 | A1 | 4/1997 |
| JP | 03033218 | A | 2/1991 |
| JP | 08035121 | A | 2/1996 |
| WO | WO 97/24916 | A3 | 7/1997 |

*Primary Examiner*—Leo B. Tentoni
(74) *Attorney, Agent, or Firm*—Alston & Bird LLP

(57) ABSTRACT

Mechanically divisible multicomponent fibers have at least a component including poly(lactic acid) polymer and at least a second component including at aromatic polyester. The multicomponent fibers are particularly useful in the manufacture of nonwoven structures, and in particular nonwoven structures used as synthetic suede.

70 Claims, 4 Drawing Sheets

SPLITTABLE MULTICOMPONENT POLYESTER FIBERS

CROSS-REFERENCE TO RELATED APPLICATION

This application is a divisional application of currently U.S. application Ser. No. 09/396,669, filed Sep. 15, 1999, now abandoned, which is herein incorporated by reference in its entirety.

FIELD OF THE INVENTION

The present invention is related to fine denier polyester fibers. In particular, the invention is related to fine denier polyester fibers obtained by splitting multi-component polyester fibers and to fabrics made from such fine fibers.

BACKGROUND OF THE INVENTION

Polyester has long been recognized as a desirable material for textile applications. Polyester fibers are readily formed into woven, knit, and nonwoven fabrics. Polyester fabrics are particularly attractive because they are economical, resilient, insensitive to moisture, and have superior tensile properties. It is further known that use of very fine denier polyester fibers produces a softer fabric, among other benefits. As would be expected, softness is considered to be a highly beneficial attribute in apparel applications.

Melt extrusion processes for spinning continuous filament and spunbond filaments from thermoplastic resins such as polyester are well known in the art. Meltblown processes are also known for spinning thermoplastic resins into fiber, in particular fine denier fiber. In general, melt extrusion processes provide higher strength fibers than microfibers produced using meltblown methods, which impart less orientation to the polymer and employ a lower molecular weight resin. However, it is difficult to produce fine denier fibers, in particular fibers of 2 denier or less, using conventional melt extrusion processes.

One avenue by which to overcome this difficulty is to split multicomponent continuous filament or staple fiber into fine denier filaments, or microfilaments, in which each fine denier filament has only one polymer component. It is now widely known that multicomponent fiber, also referred to as composite fiber, may be split into fine fibers comprised of the respective components, if the composite fiber is formed from polymers which are incompatible in some respect. The single composite filament thus becomes a bundle of individual component microfilaments.

Typical known splittable multicomponent fibers containing polyester include the polyester/nylon fibers described in U.S. Pat. Nos. 4,239,720, 4,118,534, and 4,364,983. Composite splittable polyester/olefin fibers are likewise described in U.S. Pat. No. 5,783,503. Tricomponent dividable fibers containing polyester are taught in U.S. Pat. No. 4,663,221.

A number of processes are known for separating fine denier filaments from multicomponent fibers. The particular process employed depends upon the specific combination of components comprising the fiber, as well as their configuration.

A common process by which to divide a multicomponent fiber involves mechanically working the fiber. Methods commonly employed to work the fiber include drawing on godet rolls, beating or carding. It is also known that fabric formation processes such as needle punching or hydroentangling may supply sufficient energy to a multicomponent fiber to effect separation. When mechanical action is used to separate multicomponent fibers, the fiber components must be selected to bond poorly with each other to facilitate subsequent separation. In that vein, conventional opinion has been that the polymer components must differ from each other significantly to ensure minimal interfilamentary bonding. It is for this reason that polymers having disparate chemistries, i.e., from different chemical families, have been chosen as components for mechanically dissociable composite fibers to date.

However, the use of such disparate chemistries is problematic, as polymers from different chemical families accept and retain dyestuffs differently. As an example, a nylon/polyester multicomponent fiber would typically be dyed using two dyestuffs, an acid dye for the nylon component and a disperse dye for the polyester component. Typically, the dye processes required for these dyestuffs are quite different, introducing process inefficiencies. In addition, it is extraordinarily difficult to match the color imparted to the respective components using differing dyes. This dyeing phenomenon is noted in U.S. Pat. No. 4,118,534, in which a nylon/copolyester multicomponent fiber was dyed with the "same color" acid and cationic dyes for the nylon and copolyester components, respectively. The dyes produced different colors on their respective microfilaments, giving rise to a "halo" effect.

Currently, to produce fine denier fabrics having uniform color, a multicomponent fiber comprised of a desired polymer and a soluble polymer is formed. The soluble polymer is then dissolved out of the composite fiber, leaving the desired microfilaments to be dyed. U.S. Pat. No. 5,593,778 utilizes such a process, in which a poly(lactic acid) copolymer component is dissolved away, thereby providing fine denier copolyester filaments. A comparable process is given in U.S. Pat. No. 4,663,221, in which a matrix component is dissolved away using a solvent such as toluene, to yield a fiber bundle comprised of polyurethane and polyester microfilaments. U.S. Pat. No. 5,162,074 also describes this method in general terms, recommending the use of polystyrene as a soluble component in the production of fine denier filaments. In general, polystyrene is soluble in hydrocarbon solvents, such as toluene.

The use of dissolvable matrixes to produce fine denier filaments is problematic. First, the manufacturing yields are inherently low because a significant portion of the multiconstituent fiber must be destroyed to produce the microfilaments. Secondly, the wastewater or spent hydrocarbon solvent generated by such processes poses an environmental issue. Third, the time required to dissolve the matrix component out of the composite fiber further exacerbates manufacturing inefficiencies.

Based on the foregoing, although a number of methods for splitting multicomponent fibers to obtain fine denier filaments are known, there is still need for improvement.

SUMMARY OF THE INVENTION

The present invention provides splittable multicomponent fibers and fiber bundles which include a plurality of fine denier filaments having many varied applications in the textile and industrial sector. The fibers can exhibit many advantageous properties, such as a soft, silk-like hand, high covering power, and the like. Further the fiber bundles can be uniformly dyeable. The present invention further provides fabrics formed of the multicomponent fibers and fiber bundles, as well as an economical, environmentally friendly process by which to produce fine denier polyester filaments.

In particular, the invention provides mechanically divisible or splittable fibers formed of polyester components. The fibers can have a variety of configurations, including pie/wedge fibers, segmented round fibers, segmented oval fibers, segmented rectangular fibers, segmented ribbon fibers, and segmented multilobal fibers. Further, the mechanically splittable multicomponent fibers can be in the form of continuous filaments, staple fibers, or meltblown fibers. The splittable fibers may be dissociated by a variety of mechanical actions, such as impinging with high pressure water, carding, crimping, drawing, and the like.

In one particularly advantageous aspect of the invention, the divisible multicomponent fiber includes at least one aliphatic polyester component, advantageously poly(lactic acid), and at least one aromatic polyester component. The polymer components are dissociable by mechanical means to form a bundle of fine denier polyester fibers. A particularly advantageous embodiment is a splittable multicomponent fiber formed of equal parts of poly(lactic acid) and poly(ethylene terephthalate) in a pie/wedge configuration.

The instant invention also provides a fiber bundle which includes a plurality of dissociated polyester microfibers of different polyester compositions. Specifically the fiber bundle include a plurality of aliphatic polyester microfilaments, advantageously poly(lactic acid) microfilaments, and aromatic polyester microfilaments. In general, the microfilaments of the present invention range in size from 0.05 to 1.5 denier.

The multicomponent fibers can be formed into a variety of textile structures, including nonwoven webs, either prior to or after fiber dissociation. Fabrics made using the fine denier fibers of the present invention are both economical to produce and behave in important ways as fabrics made entirely of polyester. As noted previously, earlier fabrics containing mechanically splittable composite filaments were based on disparate component chemistries. A typical conventional fabric produced from mechanically splittable composite fibers includes nylon and poly(ethylene terephthalate) microfilaments. As noted previously, such fabric must be dyed with one dye for the polyester microfilaments and a second dye for the nylon microfilaments. Often, this would require two separate dyeing processes, and it is very difficult to match the shade of the two fine denier fibers.

However, previous attempts to overcome this difficulty by making mechanically splittable fibers from pairs of polyesters have failed, because most polyesters have too high an affinity for each other to allow the segments to be split easily. Surprisingly, the inventors have found that an aliphatic polyester polymer, advantageously poly(lactic acid), can be made into an easily-splittable segmented fiber with aromatic polyesters, such as poly(ethylene terephthalate). The resulting composite fiber can be dyed with disperse dyes before or after splitting, thereby allowing a one-step "union" dyeing. Union dyeing is a process in which the same color is imparted to different fibers contained in a fabric by means of a one bath process, thus providing fabric having a uniform color.

Another aspect of the invention teaches fabrics formed from mechanically splittable multicomponent fibers of poly (lactic acid) and aromatic polyester components, as well as the methods by which to produce such fabrics. In this aspect of the invention, the multicomponent fibers can be divided into microfilaments either prior to, during, or following fabric formation. Fabrics of the present invention may generally be formed by weaving, knitting, or nonwoven processes. Advantageously the fabric is a dry-laid nonwoven fabric formed from the multicomponent fibers of the present invention. Another advantageous fabric is a dry-laid nonwoven fabric bonded by hydroentangling.

Products comprising the fabric of the present invention provide further advantageous embodiments. Particularly preferred products include synthetic suede fabrics and filtration media.

By providing fiber bundles comprised entirely of fine denier polyester filaments, the present invention permits soft, uniformly dyeable fabrics having a high degree of coverage to be economically produced. In specific, the multiconstituent fibers of the present invention allow the production of fabrics containing fine denier polyester filaments which may be formed without hydrocarbon solvents or extraordinary waste, and which may be dyed to a uniform shade in a single dyeing operation.

Further understanding of the processes and systems of the invention will be understood with reference to the brief description of the drawings and detailed description which follows herein.

DETAILED DESCRIPTION OF THE INVENTION

The present invention will be described more fully hereinafter in connection with illustrative embodiments of the invention which are given so that the present disclosure will be thorough and complete and will fully convey the scope of the invention to those skilled in the art. However, it is to be understood that this invention may be embodied in many different forms and should not be construed as being limited to the specific embodiments described and illustrated herein. Although specific terms are used in the following description, these terms are merely for purposes of illustration and are not intended to define or limit the scope of the invention. As an additional note, like numbers refer to like elements throughout.

Referring now to FIG. 1, cross sectional views of exemplary multicomponent fibers of the present invention are provided. The multicomponent fibers of the invention, designated generally as 4, include at least two structured polymeric components, a first component 6, advantageously comprised of a poly(lactic acid) polymer, and a second component 8, comprised of an aromatic polyester polymer.

In general, multicomponent fibers are formed of two or more polymeric materials which have been extruded together to provide continuous contiguous polymer segments which extend down the length of the fiber. For purposes of illustration only, the present invention will generally be described in terms of a bicomponent fiber. However, it should be understood that the scope of the present invention is meant to include fibers with two or more components. In addition, the term "fiber" as used herein means both fibers of finite length, such as conventional staple fiber, as well as substantially continuous structures, such as filaments, unless otherwise indicated.

Figure 1A:
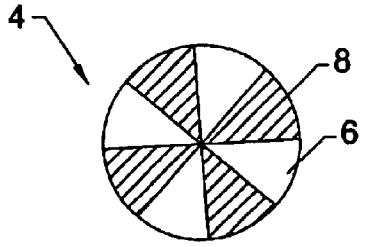
FIGS. 1A–1E are cross sectional views of exemplary embodiments of multicomponent fibers in accordance with the present invention.
Figure 1B:
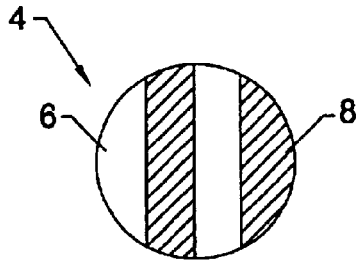
Figure 1C:
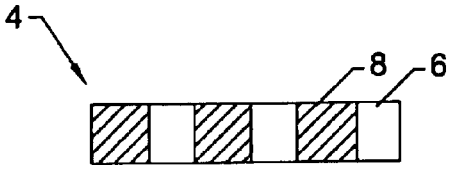
Figure 1D:
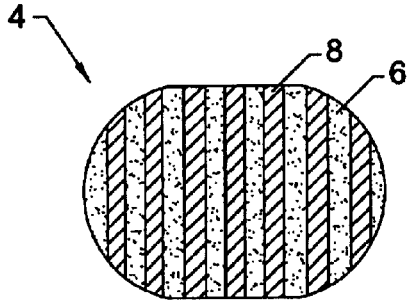
Figure 1E:
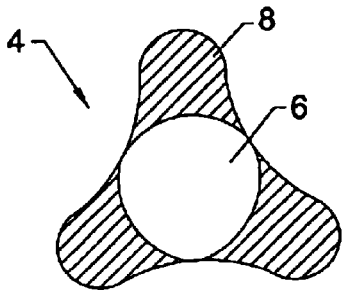

As illustrated in FIGS. 1A–1E, a wide variety of fiber configurations that allow the polymer components to be free to dissociate are acceptable. Typically, the fiber components are arranged so as to form distinct unocclusive cross-sectional segments along the length of the fiber so that none of the components is physically impeded from being separated. One advantageous embodiment of such a configuration is the pie/wedge arrangement, shown in FIG. 1A. The pie/wedge fibers can be hollow or non-hollow fibers. In particular, FIG. 1A provides a bicomponent filament having eight alternating segments of triangular shaped wedges of poly(lactic acid) components 6 and aromatic polyester components 8. It should be recognized that more than eight or less than eight segments can be produced in filaments made in accordance with the invention. Other fiber configurations as known in the art may be used, such as but not limited to, the segmented configuration shown in FIG. 1B. Reference is made to U.S. Pat. No. 5,108,820 to Kaneko et al., U.S. Pat. No. 5,336,552 to Strack et al., and U.S. Pat. No. 5,382,400 to Pike et al. for a further discussion of multicomponent fiber constructions.

Further, the multicomponent fibers need not be conventional round fibers. Other useful shapes include the segmented rectangular configuration shown in FIG. 1C, the segmented oval configuration in FIG. 1D, and the multilobal configuration of FIG. 1E. Such unconventional shapes are further described in U.S. Pat. No. 5,277,976 to Hogle et al, and U.S. Pat. Nos. 5,057,368 and 5,069,970 to Largman et al.

Both the shape of the fiber and the configuration of the components therein will depend upon the equipment which is used in the preparation of the fiber, the process conditions, and the melt viscosities of the two components. A wide variety of fiber configurations are possible. As will be appreciated by the skilled artisan, typically the fiber configuration is chosen such that one component does not encapsulate, or only partially encapsulates, other components.

Further, to provide dissociable properties to the composite fiber, the polymer components are chosen so as to be mutually incompatible. In particular, the polymer components do not substantially mix together or enter into chemical reactions with each other. Specifically, when spun together to form a composite fiber, the polymer components exhibit a distinct phase boundary between them so that substantially no blend polymers are formed, preventing dissociation. In addition, a balance of adhesion/incompatibility between the components of the composite fiber is considered highly beneficial. The components advantageously adhere sufficiently to each other to allow the unsplit multicomponent fiber to be subjected to conventional textile processing such as winding, twisting, weaving, or knitting without any appreciable separation of the components until desired. Conversely, the polymers should be sufficiently incompatible so that adhesion between the components is sufficiently weak, thereby allowing ready separation upon the application of sufficient external force.

In general, a first component of the fibers of the invention includes an aliphatic polyester polymer. A particularly advantageous component is comprised of poly(lactic acid) (PLA). Further examples of aliphatic polyesters which may be useful in the present invention include without limitation fiber forming polymer formed from (1) a combination of an aliphatic glycol (e.g., ethylene, glycol, propylene glycol, butylene glycol, hexanediol, octanediol or decanediol) or an oligomer of ethylene glycol (e.g., diethylene glycol or triethylene glycol) with an aliphatic dicarboxylic acid (e.g., succinic acid, adipic acid, hexanedicarboxylic acid or decaneolicarboxylic acid) or (2) the self condensation of hydroxy carboxylic acids other than poly(lactic acid), such as polyhydroxy butyrate, polyethylene adipate, polybutylene adipate, polyhexane adipate, and copolymers containing them.

Poly(lactic acid) is particularly attractive for use in the present invention because it is a relatively inexpensive thermoplastic polyester resin having adequate heat resistance, with a melting point of approximately 178° C. In addition, the use of poly(lactic acid) in splittable fibers is especially advantageous because poly(lactic acid) develops tensile properties which are comparable or improved in comparison to the polyester and polyamide polymers traditionally employed in splittable fibers.

Poly(lactic acid) polymer is generally prepared by the self-condensation of lactic acid. However, it will be recognized by one skilled in the art that a chemically equivalent material may also be prepared by the polymerization of lactide. Therefore, as used herein, the term "poly(lactic acid) polymer" is intended to represent the polymer that is prepared by either the polymerization of lactic acid or lactide. Reference is made to U.S. Pat. Nos. 5,698,322; 5,142,023; 5,760,144; 5,593,778; 5,807,973; and 5,010,145, the entire disclosure of each of which is hereby incorporated by reference.

Lactic acid and lactide are known to be asymmetrical molecules, having two optical isomers referred to, respectively as the levorotatory (hereinafter referred to as "L") enantiomer and the dextrorotatory (hereinafter referred to as "D") enantiomer. As a result, by polymerizing a particular enantiomer or by using a mixture of the two enantiomers, it is possible to prepare polymers that are chemically similar yet which have widely differing properties. In particular, it has been found that by modifying the stereochemistry of a poly(lactic acid) polymer, it is possible to control the crystallinity of the polymer.

The degree of crystallinity of a PLA polymer is based on the regularity of the polymer backbone and its ability to line up with similarly shaped sections of itself or other chains. If even a relatively small amount of D-enantiomer (of either lactic acid or lactide), such as about 3 to about 4 weight percent, is copolymerized with L-enantiomer (of either lactic acid or lactide), the polymer backbone generally becomes irregularly shaped enough that it cannot line up and orient itself with other backbone segments of pure L-enantiomer polymer, thus reducing the crystallinity of the polymer. Based on the foregoing, preferably the amount of D-enantiomer present in the instant invention is such that it lowers the fiber crystallinity sufficiently to provide adequate toughness, yet does not detrimentally impact the fiber formation process or resulting fabric properties. In addition, hydrolyzed poly(lactic acid) is biodegradable. Polymer morphology strongly effects the rate of biodegradation of the hydrolyzed polymer. Therefore, as a precautionary measure, in applications in which a minimal rate of degradation is desirable, the use of higher molecular weight, highly crystalline PLA is recommended.

Advantageously, the PLA polymer also exhibits residual monomer percents effective to provide desirable melt strength, fiber mechanical strength, and fiber spinning properties. As used herein, "residual monomer percent" refers to the amount of lactic acid or lactide monomer that is unreacted yet which remains entrapped within the structure of the entangled PLA polymer chain. In general, if the residual monomer percent of a PLA polymer in a component is too high, the component may be difficult to process due to inconsistent processing properties caused by a large amount of monomer vapor being released during processing that cause variations in extrusion pressures. However, a minor amount of residual monomer in a PLA polymer in a component may be beneficial due to such residual monomer functioning as a plasticizer during a spinning process. Thus, the PLA polymer generally exhibits a residual monomer percent that is less than about 15 percent, preferably less than about 10 percent, and more preferably less than about 7 percent.

The second component of the fibers of the invention includes an aromatic polyester polymer. As used herein, the term aromatic polyester means a thermoplastic polyester polymer in which at least one monomer contains at least one aromatic ring. Thermoplastic aromatic polymers that are preferred include: (1) polyesters of alkylene glycols having 2–10 carbon atoms and aromatic diacids; (2) poly(alkylene naphthalates), which are polyesters of 2,6-naphthalenedicarboxylic acid and alkylene glycols, as for example poly(ethylene naphthalate); and (3) polyesters derived from 1,4,-cyclohexanedimethanol and terephthalic acid, as for example polycyclohexane terephthalate. In particular, the use of poly(alkylene terephthalates), especially poly(ethylene terephthalate) and poly(butylene terephthalate), is considered beneficial. Poly(ethylene terephthalate) (PET) is particularly advantageous. See also polymers set forth in WO 97/24916, the entire disclosure of which is hereby incorporated by reference. PET and other aromatic polyesters are commercially available from many manufacturers, including Eastman Chemical Co.

Each of the polymeric components can optionally include other components not adversely effecting the desired properties thereof. Exemplary materials which could be used as additional components would include, without limitation, pigments, antioxidants, stabilizers, surfactants, waxes, flow promoters, solid solvents, particulates, and other materials added to enhance processability of the first and the second components. For example, a stabilizing agent may be added to the poly(lactic acid) polymer to reduce thermal degradation which might otherwise occur during the poly(lactic acid) spinning process. The use of such stabilizing agents is disclosed in U.S. Pat. No. 5,807,973, hereby incorporated by reference. These and other additives can be used in conventional amounts.

The weight ratio of the poly(lactic acid) component and the aromatic polyester component can vary. Preferably the weight ratio is in the range of about 10:90 to 90:10, more preferably from about 20:80 to about 80:20, and most preferably from about 35:65 to about 65:35. In addition, the dissociable multicomponent fibers of the invention can be provided as staple fibers, continuous filaments, or meltblown fibers.

In general, staple, multi-filament, and spunbond multicomponent fibers formed in accordance with the present invention can have a fineness of about 0.5 to about 100 denier. Meltblown multicomponent filaments can have a fineness of about 0.001 to about 10.0 denier. Monofilament multicomponent fibers can have a fineness of about 50 to about 10,000 denier. Denier, defined as grams per 9000 meters of fiber, is a frequently used expression of fiber diameter. A lower denier indicates a finer fiber and a higher denier indicates a thicker or heavier fiber, as is known in the art.

Dissociation of the multicomponent fibers provides a plurality of fine denier filaments or microfilaments, each formed of the different polymer components of the multicomponent fiber. As used herein, the terms "fine denier filaments" and "microfilaments" include sub-denier filaments and ultra-fine filaments. Sub-denier filaments typically have deniers in the range of 1 denier per filament or less. Ultra-fine filaments typically have deniers in the range of from about 0.1 to 0.3 denier per filament. As discussed previously, fine denier filaments of low orientation have previously been obtained from relatively low molecular weight polymers by meltblowing. The present invention provides much finer polyester meltspun filament than previously available without the use of solvents. In addition, the invention provides continuous fine denier polyester filaments to be produced at commercial throughputs from relatively high molecular weight polymers with acceptable manufacturing yields.

Figure 2B:
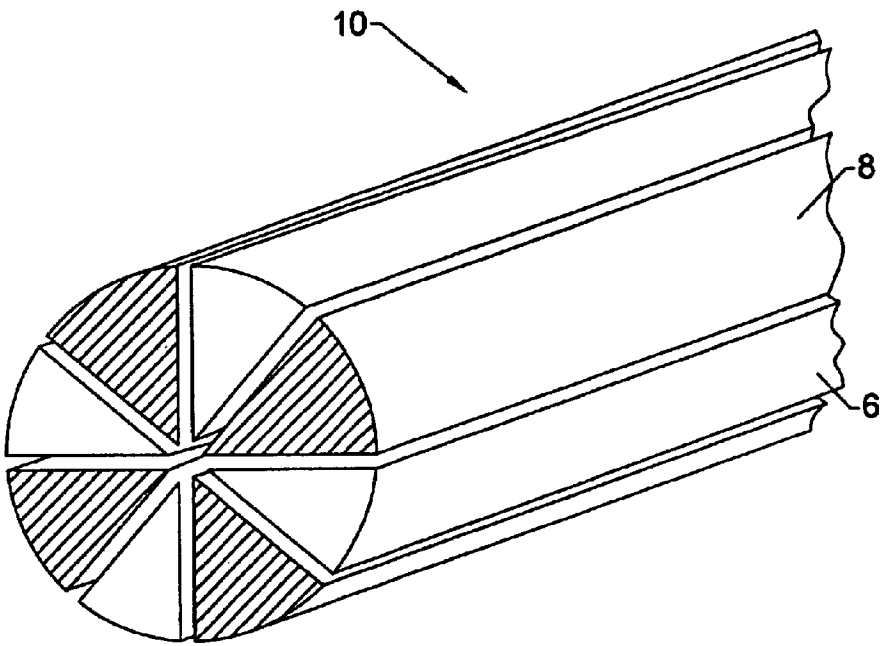
FIGS. 2A and 2B are cross sectional and longitudinal views, respectively, of an exemplary dissociated fiber in accordance with one embodiment of the present invention.
Figure 2A:
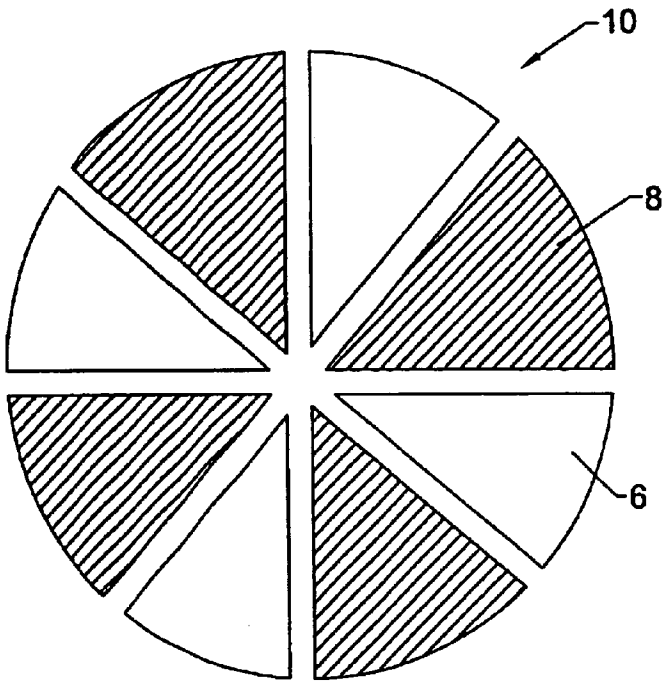

FIG. 2 illustrates an exemplary multicomponent fiber of the present invention which has been separated into a fiber bundle 10 of microfilaments as described above. In the illustrated example, the multicomponent fiber has been divided into four poly(lactic acid) microfilaments 6 and four aromatic polyester microfilaments 8, thereby providing an eight filament fiber bundle. In a typical example, a multicomponent fiber having 4 to 24, preferably 8 to 20, segments is produced. Generally, the tenacity of the multicomponent fiber ranges from about 1 to about 5.5, advantageously from about 2.0 to about 4.5 grams/denier (gpd). The tenacity of the poly(lactic acid) microfilaments produced in accordance with the present invention can range from about 1.0 to about 5.5 gpd, and typically from about 2.5 to about 4.5, while tenacity for the aromatic polyester fine denier filaments can range from about 1 to about 5.5, typically from about 2.0 to about 4.0 gpd. Grams per denier, a unit well known in the art to characterize fiber tensile strength, refers to the force in grams required to break a given filament or fiber bundle divided by that filament or fiber bundle's denier.

It was altogether unexpected that this particular combination of polymer components would readily dissociate when subjected to sufficient mechanical action. Heretofore, mechanically divisible fibers have been comprised of widely differing polymer types to ensure adequate dissociation. It is surprising that the multicomponent fibers of the present invention, comprised of components from the same chemical family, namely polyesters, would be capable of splitting into fine denier component filaments. While not wishing to be bound by any theory, it is believed that, although both components are polyesters, the difference in aromatic character between the components gives rise to sufficient incompatibility to allow mechanical splitting to occur.

The multicomponent fibers of the present invention may be dissociated into separate aliphatic polyester microfilaments (such as poly(lactic acid) microfilaments) and aromatic polyester microfilaments by any means that provides sufficient flex or mechanical action to the fiber to fracture and separate the components of the composite fiber. As used herein, the terms "splitting," "dissociating," or "dividing" mean that at least one of the fiber components is separated completely or partially from the original multicomponent fiber. Partial splitting can mean dissociation of some individual segments from the fiber, or dissociation of pairs or groups of segments, which remain together in these pairs or groups, from other individual segments, or pairs or groups of segments from the original fiber. As illustrated in FIG. 2, the fine denier components can remain in proximity to the remaining components as a coherent fiber bundle 10 of fine denier poly(lactic acid) microfilaments 6 and aromatic polyester microfilaments 8. However, as the skilled artisan will appreciate, in some processing techniques, such as hydroentanglement, or where the fibers are split prior to fabric formation, the fibers originating from a common fiber source may be further removed from one another. Further, the terms "splitting," "dissociating," or "dividing" as used herein also include partial splitting.

Figure 3:
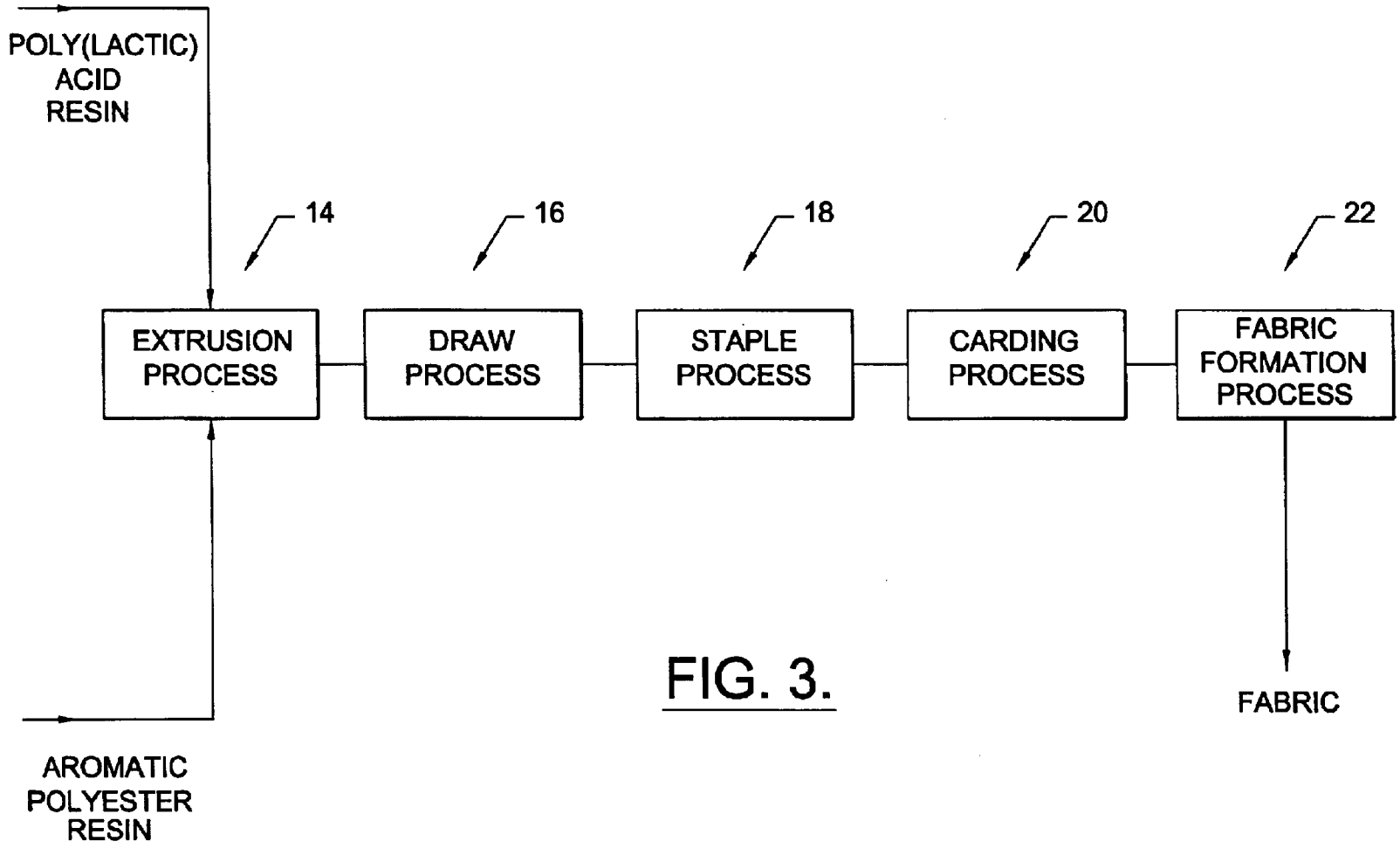
FIG. 3 is a flow diagram illustrating a fabric formation process according to one embodiment of the present invention.

Turning now to FIG. 3, an exemplary process for making a fabric in accordance with one embodiment of the invention is illustrated. Specifically, FIG. 3 illustrates an extrusion process 14, followed by a draw process 16, a staple process 18, a carding process 20, and a fabric formation process 22.

The extrusion process 14 for making multicomponent continuous filament fibers is well known and need not be described here in detail. Generally, to form a multicomponent fiber, at least two polymers are extruded separately and fed into a polymer distribution system wherein the polymers are introduced into a spinneret plate. The polymers follow separate paths to the fiber spinneret and are combined in a spinneret hole. The spinneret is configured so that the extrudant has the desired overall fiber cross section (e.g., round, trilobal, etc.). Such a process is described, for example, in Hills U.S. Pat. No. 5,162,074, the contents of which are incorporated herein by reference in their entirety.

In the present invention, an aliphatic polyester polymer, such as poly(lactic acid) polymer, stream and an aromatic polyester polymer stream are fed into the polymer distribution system. In one advantageous embodiment, a polylactic acid polymer stream and a poly(ethylene terephthalate) stream are employed. The polymers typically are selected to have melting temperatures such that the polymers can be spun at a polymer throughput that enables the spinning of the components through a common capillary at substantially the same temperature without degrading one of the components.

Following extrusion through the die, the resulting thin fluid strands, or filaments, remain in the molten state for some distance before they are solidified by cooling in a surrounding fluid medium, which may be chilled air blown through the strands. Once solidified, the filaments are taken up on a godet or other take-up surface. In a continuous filament process, the strands are taken up on a godet which draws down the thin fluid streams in proportion to the speed of the take-up godet. Continuous filament fiber may further be processed into staple fiber. In processing staple fibers, large numbers, e.g., 10,000 to 1,000,000 strands, of continuous filament are gathered together following extrusion to form a tow for use in further processing, as is known in that art.

Rather than being taken up on a godet, continuous multicomponent fiber may also be melt spun as a direct laid nonwoven web. In a spunbond process, for example, the strands are collected in a jet, such as an air jet or air attenuator, following extrusion through the die and then blown onto a take-up surface such as a roller or a moving belt to form a spunbond web. As an alternative, direct laid composite fiber webs may be prepared by a meltblown process, in which air is ejected at the surface of a spinneret to simultaneously draw down and cool the thin fluid polymer streams which are subsequently deposited on a take-up surface in the path of cooling air to form a fiber web.

Regardless of the type of melt spinning procedure which is used, typically the thin fluid streams are melt drawn in a molten state, i.e. before solidification occurs, to orient the polymer molecules for good tenacity. Typical melt draw down ratios known in the art may be utilized. The skilled artisan will appreciate that specific melt draw down is not required for meltblowing processes.

When a continuous filament or staple process is employed, it may be desirable to subject the strands to a draw process 16. In the draw process the strands are typically heated past their glass transition point and stretched to several times their original length using conventional drawing equipment, such as, for example, sequential godet rolls operating at differential speeds. As is known in the art, draw ratios of 2.0 to 5.0 times are typical for polyester fibers. Optionally, the drawn strands may be heat set, to reduce any latent shrinkage imparted to the fiber during processing, as is further known in the art.

Following drawing in the solid state, the continuous filaments can be cut into a desirable fiber length in a staple process 18. The length of the staple fibers generally ranges from about 25 to about 50 millimeters, although the fibers can be longer or shorter as desired. See, for example, U.S. Pat. No. 4,789,592 to Taniguchi et al. and U.S. Pat. No. 5,336,552 to Strack et al. Optionally, the fibers may be subjected to a crimping process prior to the formation of staple fibers, as is known in the art. Crimped composite fibers are useful for producing lofty woven and nonwoven fabrics since the microfilaments split from the multicomponent fibers largely retain the crimps of the composite fibers and the crimps increase the bulk or loft of the fabric. Such lofty fine fiber fabric of the present invention exhibits cloth-like textural properties, e.g., softness, drapability and hand, as well as the desirable strength properties of a fabric containing highly oriented fibers.

Figure 4:
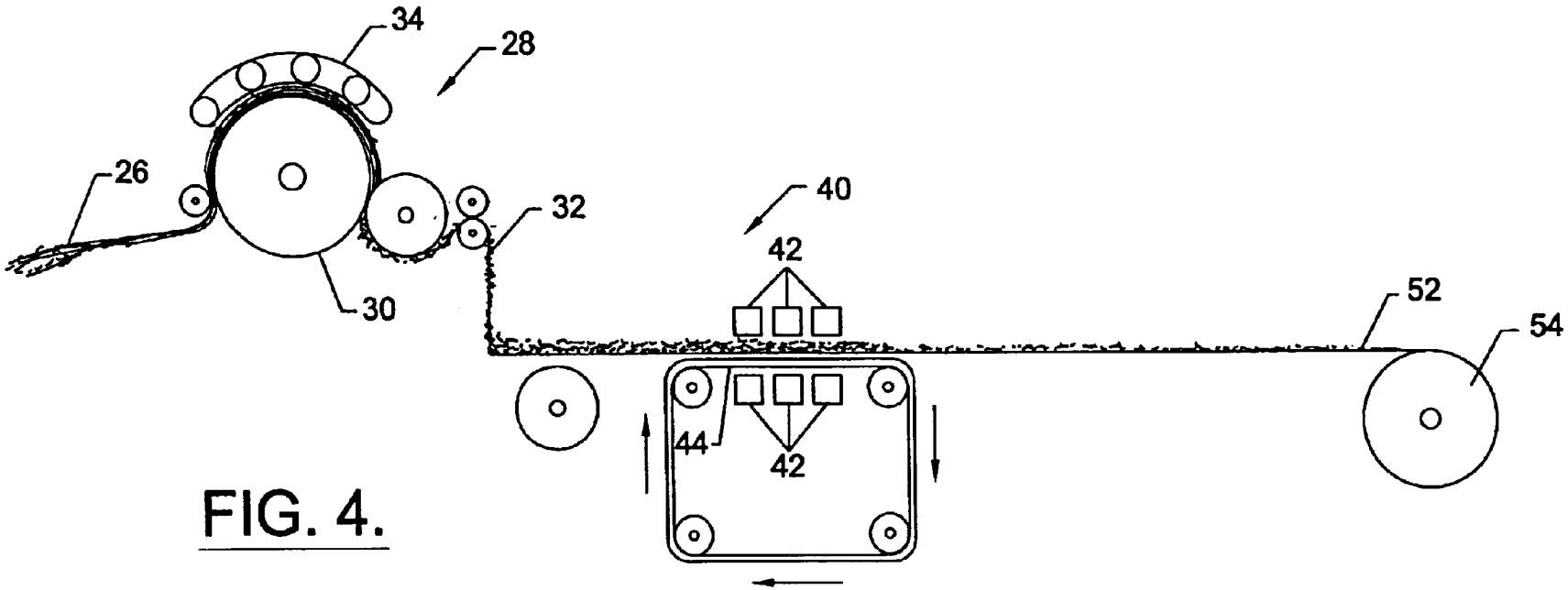
FIG. 4 schematically illustrates one fabric formation process of the invention which includes carding and hydroentangling steps.

The staple fiber thus formed is then fed into a carding process 20. A more detailed schematic illustration of a carding process is provided in FIG. 4. As shown in FIG. 4, the carding process can include the step of passing staple tow 26 through a carding machine 28 to align the fibers of the staple tow as desired, typically to lay the fibers in roughly parallel rows, although the staple fibers may be oriented differently. The carding machine 28 is comprised of a series of revolving cylinders 34 with surfaces covered in teeth. These teeth pass through the staple tow as it is conveyed through the carding machine on a moving surface, such as a drum 30. The carding process produces a fiber web 32.

Referring back to FIG. 3, in one advantageous embodiment of the invention, carded fiber web 32 is subjected to a fabric formation process to impart cohesion to the fiber web. In one aspect of that embodiment, the fabric formation process includes the step of bonding the fibers of fiber web 32 together to form a coherent unitary nonwoven fabric. The bonding step can be any known in the art, such as mechanical bonding, thermal bonding, and chemical bonding. Typical methods of mechanical bonding include hydroentanglement and needle punching.

In a preferred embodiment of the present invention, a hydroentangled nonwoven fabric is provided. A schematic of one hydroentangling process suitable for use in the present invention is provided in FIG. 4. As shown in FIG. 4, fiber web 32 is conveyed longitudinally to a hydroentangling station 40 wherein a plurality of manifolds 42, each including one or more rows of fine orifices, direct high pressure water jets through fiber web 32 to intimately hydroentangle the staple fibers, thereby providing a cohesive, nonwoven fabric 52.

The hydroentangling station 40 is constructed in a conventional manner as known to the skilled artisan and as described, for example, in U.S. Pat. No. 3,485,706 to Evans, which is hereby incorporated by reference. As known to the skilled artisan, fiber hydroentanglement is accomplished by jetting liquid, typically water, supplied at a pressure of from about 200 psig up to 1800 psig or greater to form fine, essentially columnar, liquid streams. The high pressure liquid streams are directed toward at least one surface of the composite web. In one embodiment of the invention water at ambient temperature and 200 bar is directed towards both surfaces of the web. The composite web is supported on a foraminous support screen 44 which can have a pattern to form a nonwoven structure with a pattern or with apertures or the screen can be designed and arranged to form a hydraulically entangled composite which is not patterned or apertured. The fiber web 32 can be passed through the hydraulic entangling station 40 a number of times for hydraulic entanglement on one or both sides of the composite web or to provide any desired degree of hydroentanglement.

Optionally, the nonwoven webs and fabrics of the present invention may be thermally bonded. In thermal bonding, heat and/or pressure are applied to the fiber web or nonwoven fabric to increase its strength. Two common methods of thermal bonding are air heating, used to produce low-density fabrics, and calendering, which produces strong, low-loft fabrics. Hot melt adhesive fibers may optionally be included in the web of the present invention to provide further cohesion to the web at lower thermal bonding temperatures. Such methods are well known in the art.

In addition, rather than producing a dry-laid nonwoven fabric, an aspect of which was previously described, a nonwoven may be formed in accordance with the instant invention by direct-laid means. In one embodiment of direct laid fabric, continuous filament is spun directly into nonwoven webs by a spunbonding process. In an alternative embodiment of direct laid fabric, multicomponent fibers of the invention are incorporated into a meltblown fabric. The techniques of spunbonding and meltblowing are known in the art and are discussed in various patents, e.g., Buntin et al., U.S. Pat. No. 3,987,185; Buntin, U.S. Pat. No. 3,972,759; and McAmish et al., U.S. Pat. No. 4,622,259. The fiber of the present invention may also be formed into a wet-laid nonwoven fabric, via any suitable technique known in that art.

While particularly useful in the production of nonwoven fabrics, the fibers of the invention can also be used to make other textile structures such as but not limited to woven and knit fabrics. Yarns prepared for use in forming such woven and knit fabrics are similarly included within the scope of the present invention. Such yarns may be prepared from continuous filaments or spun yarns comprising staple fibers of the present invention by methods known in the art, such as twisting or air entanglement.

In one advantageous embodiment of the invention, the fabric formation process is used to dissociate the multicomponent fiber into microfilaments. Stated differently, forces applied to the multicomponent fibers of the invention during fabric formation in effect split or dissociate the polymer components to form microfilaments. The resultant fabric thus formed is comprised, for example, of a plurality of microfilaments 6 and 8 shown in FIG. 2, and described previously. In a particularly advantageous aspect of the invention, the hydroentangling process used to form the nonwoven fabric dissociates the composite fiber. In the alternative, the carding, drawing, or crimping processes previously described may be used to split the multicomponent fiber. Optionally, the composite fiber may be divided after the fabric has been formed by application of mechanical forces thereto. In addition, the multicomponent fiber of the present invention may be separated into microfilaments before or after formation into a yarn.

Fabrics and yarns produced in accordance with the instant invention may optionally be dyed. In general, polyester fibers lack the reactive cites possessed by many types of fibers, and are thus typically dyed with disperse dyes. The disperse dyeing process physically entraps dye in the fiber, and is performed at high temperatures or by the use of swelling agents and carriers, as is well known in that art. A wide variety of polyesters may be dyed using disperse dye processes, including the poly(lactic acid) and aromatic polyesters employed in the present invention. In particular, the fabrics of the present invention may be dyed by means of a thermosol process, in which a disperse dye is applied to the fabric as a water emulsion, dried, and passed through a hot flue or over heated rollers at about 400° F. to sublime the dyestuff into the polyester fiber. See the Encyclopedia of Science and Technology.

Because they are simultaneously dyed by a common dye in a common dye process, the poly(lactic acid) and aromatic polyester components comprising the composite fiber are dyed uniformly, that is, to the same hue. Non-uniform dyeing, in which microfilaments of disparate chemistries resulting from splitting a multicomponent fiber are dyed to different shades, gives rise to an unwanted heather or "halo" appearance. In addition to a uniform initial appearance, the poly(lactic acid) and aromatic polyester microfilaments of the present invention are expected to maintain an equivalent hue to one another as the fabric which they comprise is exposed to light, laundering, abrasion, and aging.

The fabrics of the present invention provide a combination of desirable properties of conventional fine denier fabrics and highly oriented fiber fabrics. These properties include fabric uniformity, uniform fiber coverage, good barrier properties and high fiber surface area. The fabrics of the present invention also exhibit highly desirable strength properties, desirable hand and softness, and can be produced to have different levels of loft. In addition to the foregoing benefits, fabric of the present invention may also be uniformly dyed and economically produced.

Beneficial products can be produced with the fabrics of the present invention, as well. In particular, nonwoven fabrics formed from the multicomponent fibers of the invention are suitable for a wide variety of end uses. In one particularly advantageous embodiment, nonwoven fabric of the instant invention may be used as a synthetic suede. In this embodiment, the microfilaments comprising the nonwoven fabric provide the recovery properties, appealing hand, and tight texture required in synthetic suedes. In addition, nonwoven articles produced in accordance with the invention possess adequate strength, superior barrier and cover. Based on these properties, nonwoven fabrics made with the splittable filaments of the instant invention should readily find use as filtration media, producing long life filters for filtering lubrication oils and the like. Other applications include garments (especially synthetic suedes), upholstery and wiping cloths.

The present invention will be further illustrated by the following non-limiting example.

EXAMPLE 1

Continuous multifilament melt spun fiber is produced using a bicomponent extrusion system. A sixteen segment pie/wedge bicomponent fiber is produced having eight segments of poly(lactic acid) polymer and eight segments of PET polymer. The weight ratio of PET polymer to poly (lactic acid) polymer in the bicomponent fibers is 50/50. The PET employed is a 0.55 I.V. polyester, commercially available as Tairilyn polyester from Nan Ya. The poly(lactic acid) polymer is EcoPLA 5019B from Cargill Dow Polymers.

Following extrusion, the filaments are subsequently drawn 3.2 times, thereby yielding a 3 denier multifilament multicomponent fiber. The fiber is then crimped and cut to 1½ inch length staple fiber. This staple fiber is carded to form a web that is subsequently hydroentangled using water jets operating at 200 bar pressure. The water jets simultaneously entangle the fibers to give the web strength and split the fibers substantially into individual poly(lactic acid) and polyester microfibers. The resulting fabric has a luxurious hand and drape and a small pore size.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for producing uniformly dyeable microfilament fibers, said method comprising:

extruding a plurality of multicomponent fibers comprising at least on polymer component comprising a poly(lactic acid) polymer and at least one polymer component comprising an aromatic polyester polymer;

mechanically separating the multicomponent fibers to form a fiber bundle comprising a plurality of poly(lactic acid) microfilaments and aromatic polyester microfilaments; and simultaneously disperse dyeing the poly(lactic acid) microfilaments and aromatic polyester microfilaments, said dyeing step occurring prior to or after said separating step.

2. The method of claim 1, wherein said dyeing step occurs prior to said separating step.

3. The method of claim 1, wherein said dyeing step occurs after said separating step.

4. The method of claim 1, wherein the configuration of the multicomponent fiber, is selected from the group consisting of pie and wedge, segmented round, segmented oval, segmented rectangular, segmented ribbon, and segmented multilobal.

5. The method of claim 1, wherein the fiber is a pie sad wedge fiber.

6. The method of claim 1, wherein the weight ratio of poly(lactic acid) to polyester is in the range of about 10:90 to about 90:10.

7. The method of claim 1, wherein the weight ratio of poly(lactic acid) to polyester is in the range of about 20:80 to about 80:20.

8. The method of claim 1, wherein the weight ratio of poly(lactic acid) to polyester is in the range of about 36:65 to about 65:35.

9. The method of claim 1, further comprising the step of forming a yarn of said microfilaments prior to said dyeing step.

10. The method of claim 1, wherein the aromatic polyester polymer comprises a polymer selected from the group consisting of polyethylene terephthalate, polybutylene terephthalate, polycyclohexane terephthalate, polyethylene napthalate, and copolymers and mixtures thereof.

11. The method of claim 1, wherein the aromatic polyester is polyethylene terephthalate.

12. The method of claim 1, wherein the multicomponent fiber is selected from the group consisting of continuous filaments, staple fibers, and meltblown fibers.

13. The method of claim 1, wherein the multicomponent fiber is a staple fiber.

14. The method of claim 1, wherein said separating stop is selected from the group consisting of impinging the multicomponent fiber with high pressure water, carding the multicomponent fiber, crimping the fiber, and drawing the multicomponent fiber.

15. The method of claim 1, wherein the aromatic polyester polymer is polyethylene terephthalate, the weight ratio of the poly(lactic acid) polymer component to the polyethylene terephthalate polymer component is from about 35:65 to about 65:35, and the multicomponent fiber has a pie and wedge configuration.

16. A method for producing fabric, said method comprising:

extruding a plurality of multicomponent fibers comprising at least one polymer component comprising a poly (lactic acid) polymer and at least one polymer component comprising an aromatic polyester polymer;

forming a fabric from said multicomponent fibers;

mechanically separating said multicomponent fibers to form a plurality of poly(lactic acid) microfilaments and aromatic polyester microfilaments, said separating step occurring prior to, during, or after said fabric forming step; and simultaneously disperse dyeing the poly(lactic acid) microfilaments and aromatic polyester microfilaments, said dyeing step occurring prior to or after said separating step.

17. The method of claim 16, further comprising the step of forming a yarn of said multicomponent fibers following said extrusion step and prior to said fabric forming step.

18. The method of claim 16, wherein said dyeing step occurs prior to said separating step.

19. The method of claim 16, wherein said dyeing step occurs after said separating step.

20. The method of claim 16, wherein said separating step occurs prior to said fabric forming step.

21. The method of claim 16, wherein said separating step occurs after said fabric forming step.

22. The method of claim 16, wherein the configuration of the multicomponent fibers is selected from the group consisting of pic and wedge, segmented round, segmented oval, segmented rectangular, segmented ribbon, and segmented multilobal.

23. The method of claim 16, wherein the fiber is a pie and wedge fiber.

24. The method of claim 16, wherein the weight ratio of poly(lactic acid) to polyester is in the range of about 10:90 to about 90:10.

25. The method of claim 16, wherein the weight ratio of poly(lactic acid) to polyester is in the range of about 20:80 to about 80:20.

26. The method of claim 16, wherein the weight ratio of poly(lactic acid) to polyester is in the range of about 36:65 to about 65:35.

27. The method of claim 16, wherein the aromatic polyester polymer comprises a polymer selected from the group consisting of polyethylene terephthalate, polybutylene terephthalate, polycyclohexane terephthalate, polyethylene napthalate, and copolymers and mixtures thereof.

28. The method of claim 16, wherein the aromatic polyester is polyethylene terephthalate.

29. The method of claim 16, wherein the multicomponent fiber is selected from the group consisting of continuous filaments, staple fibers, and meltblown fibers.

30. The method of claim 16, wherein the multicomponent fiber is a staple fiber.

31. The method of claim 16, wherein said separating step is selected from the group consisting of impinging the multicomponent fiber with high pressure water, carding the multicomponent fiber, crimping the fiber, and drawing the multicomponent fiber.

32. The method of claim 16, wherein the aromatic polyester polymer is polyethylene terephthalate, the weight ratio of the poly(lactic acid) polymer component to the polyethylene terephthalate polymer component as from about 35:65 to about 65:35, and the multicomponent fiber has a pie and wedge configuration.

33. The method of claim 16, wherein said step of torn dug a fabric comprises forming a woven fabric, a knit fabric, or a nonwoven fabric.

34. The method of claim 16, wherein said fabric is a nonwoven fabric selected from the group consisting of wet-laid nonwoven fabrics, dry-laid nonwoven fabrics, and direct-laid nonwoven fabrics.

35. The method of claim 16, wherein said fabric is a dry-laid nonwoven fabric.

36. The method of claim 16, wherein said fabric is a hydroentangled dry-laid nonwoven fabric.

37. The method of claim 16, further comprising after laid extruding step the steps of:

forming a tow from a plurality of said multicomponent fibers;

drawing said tow;

chopping said drawn tow into staple fibers; and carding said staple fibers to form a carded fiber web.

38. The method if claim 37, further comprising the step of crimping said multicomponent fibers prior to said chopping step.

39. The method of claim 38, further comprising the stop of bonding said carded fiber web to form a unitary nonwoven fabric.

40. The method of claim 39, wherein said bonding step is selected from the group consisting of mechanical bonding, thermal bonding and chemical bonding.

41. The method of claim 39, wherein said bonding step is selected from the group consisting of hydroentanglement, needle punching, air heating and calendering.

42. The method of claim 39, wherein the carded fiber web further comprises a hot melt adhesive.

43. The method of claim 39, wherein said separating step occurs simultaneously with at least one of said drawing step, crimping step, chopping step, carding step and bonding step.

44. The method of claim 1, wherein said separating step comprises impinging the multicomponent fiber with high pressure water.

45. The method of claim 1, wherein said separating step comprises carding the multicomponent fiber.

46. The method of claim 1, wherein said separating step comprises crimping the multicomponent fiber.

47. The method of claim 1, wherein said separating step comprises drawing the multicomponent fiber.

48. The method of claim 16, wherein said separating step comprises impinging the multicomponent fiber with high pressure water.

49. The method of claim 16, wherein said separating step comprises carding the multicomponent fiber.

50. The method of claim 16, wherein said separating step comprises crimping the multicomponent fiber.

51. The method of claim 16, wherein said separating step comprises drawing the multicomponent fiber.

52. The method of claim 39, wherein said bonding step comprises mechanical bonding.

53. The method of claim 52, wherein said mechanical bonding comprising hydroentangling.

54. The method of claim 52, wherein said mechanical bonding comprises needle punching.

55. The method of claim 39, wherein said bonding comprises thermal bonding.

56. A method for producing uniformly dyeable microfilament fibers, said method comprising:

extruding a plurality of multicomponent fibers comprising at least one polymer component comprising a poly (lactic acid) polymer and at least one polymer component comprising an aromatic polyester polymer; and mechanically separating said multicomponent fibers to form a fiber bundle comprising a plurality of poly(lactic acid) microfilaments and aromatic polyester microfilaments.

57. The method of claim 56, wherein said separating step comprises impinging the multicomponent fiber with high pressure water.

58. The method of claim 56, wherein said separating step comprises carding the multicomponent fiber.

59. The method of claim 56, wherein said separating step comprises crimping the multicomponent fiber.

60. The method of claim 56, wherein said separating step comprises drawing the multicomponent fiber.

61. A method for producing fabric, said method comprising:

extruding a plurality of multicomponent fibers comprising at least one polymer component comprising a poly (lactic acid) polymer and at leant one polymer component comprising an aromatic polyester polymer;

forming a fabric from said multi component fibers; and mechanically separating said multicomponent fibers to form a plurality of poly(lactic acid) microfilaments and aromatic polyester microfilaments, said separating step occurring prior to, during or after said fabric forming step.

62. The method of claim 61, wherein said separating step comprises impinging the multicomponent fiber with high pressure water.

63. The method of claim 61, wherein said separating step comprises carding the multicomponent fiber.

64. The method of claim 61, wherein said separating step comprises crimping the multicomponent fiber.

65. The method of claim 61, wherein said separating step comprises drawing the multicomponent fiber.

66. The method of claim 61, further comprising alter said extruding step the stops of:

forming a tow from a plurality of said multicomponent fibers;

drawing said tow;

chopping said drawn tow into staple fibers;

carding said staple fibers to form a carded fiber web; and bonding said carded fiber web to form a unitary nonwoven fabric.

67. The method of claim 66, wherein said bonding step comprises mechanical bonding.

68. The method of claim 67, wherein said mechanical bonding comprising hydroentangling.

69. The method of claim 67, wherein said mechanical bonding comprises needle punching.

70. The method of claim 66, wherein said bonding comprises thermal bonding.

* * * * *

UNITED STATES PATENT AND TRADEMARK OFFICE

CERTIFICATE OF CORRECTION

PATENT NO. : 6,780,357 B2
DATED : August 24, 2004
INVENTOR(S) : Dugan, Jeffrey et al.

It is certified that error appears in the above-identified patent and that said Letters Patent is hereby corrected as shown below:

Title page,
Item [54], Title should read:
-- METHOD OF MAKING SPLITTABLE MULTICOMPONENT POLYESTER FIBERS --
Item [57], ABSTRACT, please amend to read as follows:

-- Mechanically divisible multicomponent fibers have at least a first component including poly(lactic acid) polymer and at least a second component including an aromatic polyester. The multicomponent fibers are particularly useful in the manufacture of nonwoven structures, and in particular nonwoven structures used as synthetic suede. --

Signed and Sealed this

Twenty-second Day of February, 2005

JON W. DUDAS
*Director of the United States Patent and Trademark Office*